United States Patent [19]

Molinazzi

[11] Patent Number: 4,516,367

[45] Date of Patent: May 14, 1985

[54] MODULAR SUPPORT FOR STAIRWAY STEPS

[75] Inventor: Roberto Molinazzi, Ozzano Emilia, Italy

[73] Assignee: Albini & Fontanot S.p.A., Rimini, Italy

[21] Appl. No.: 451,511

[22] Filed: Dec. 20, 1982

[30] Foreign Application Priority Data

Dec. 31, 1981 [IT] Italy ..... 3626 A/81

[51] Int. Cl.[3] ..... E04F 11/00

[52] U.S. Cl. ..... 52/182; 52/188; 108/92; 182/228

[58] Field of Search ..... 52/182, 183, 188, 184–187; 108/101, 92, 60; 182/228

[56] References Cited

U.S. PATENT DOCUMENTS

| | | | |
|---|---|---|---|
| 1,052,671 | 2/1913 | LeCount et al. | 52/182 |
| 1,063,216 | 6/1913 | Rendle et al. | 52/188 |
| 1,105,877 | 8/1914 | Buellesbach | 52/183 |
| 2,287,561 | 6/1942 | Page et al. | 52/182 |
| 3,290,839 | 12/1966 | Theisen | 52/188 |
| 3,474,882 | 10/1969 | Ernst | 52/182 |

FOREIGN PATENT DOCUMENTS

| | | | |
|---|---|---|---|
| 1434739 | 9/1969 | Fed. Rep. of Germany | 52/183 |
| 1901699 | 8/1970 | Fed. Rep. of Germany . | |
| 2938326 | 3/1981 | Fed. Rep. of Germany | 52/188 |

*Primary Examiner*—John E. Murtagh
*Assistant Examiner*—Andrew Joseph Rudy
*Attorney, Agent, or Firm*—Guido Modiano; Albert Josif

[57] ABSTRACT

The support comprises a horizontal resting deck for a respective step. A first wall including a vertical cylindrical portion is made rigid, on the convex side thereof, with said resting deck and extends above the latter. An additional wall including a vertical cylindrical portion extends fixedly below the resting deck with its concave side facing the convex side of the first wall. Said additional wall has an outer surface matching the outer surface of the first wall.

8 Claims, 5 Drawing Figures

19
20
17
4
5
3
9a
2
10
9
12
16a
17
6
16
3
2
17
13
1
14
15
16a
8
17
6
16
43
42

11
10
9
20
11
42
3a
4
5
6
7
3
41
14
15
12
14a
16
40
15a
18
3
8
6
6
43
4
9a
10
11
4

MODULAR SUPPORT FOR STAIRWAY STEPS

BACKGROUND OF THE INVENTION

This invention relates to a modular support for stairway steps.

It is a known fact that non-unitary construction stairways include a load-bearing floor on which the steps are caused to rest; said floor is only secured to the landings interconnected by the stairways. Currently employed are also stairways, wherein said floor is in the form of a sequential arrangement of supports for the individual steps. Such supports essentially comprise a deck from the opposed faces whereof there extend respective vertical sleeves set apart from each other. The lower sleeve of each support is inserted into the upper sleeve of the underlying support; that insertion allows for variation in the depth of mutual engagement of the cited sleeves and their mutual angular positions. Through the intermediary of expansion members, the two sleeves are then locked together in the desired axial and angular positions. With such prefabricated modular supports, stairways can be made with variations both in the step rise and pattern of the stairway axis, which pattern may include rectilinear sections and/or curvilinear sections. In spite of its evident advantages, the building of stairways by means of said modular supports has such drawbacks as to limit its application. Particularly complained is the difficulty in mutually positioning and locking such supports, which makes their installation complicated and expensive. Moreover, the addition of aesthetic coverings to the supports is generally required, which contributes to the overall cost of the installation.

SUMMARY OF THE INVENTION

It is an object of this invention to obviate the cited drawbacks by providing a modular step support which is particularly easy to install and adjust.

It is another object of the invention to provide a modular step support of simple design, versatile in use, and highly reliable, and having a proper look as well as a relatively low cost.

These objects are achieved, according to the invention, by this modular support for stairway steps, which is characterized in that it comprises, as a unitary construction, a horizontal resting deck for a respective step, a first wall including a vertical cylindrical portion which defines an outer surface and an inner surface and extends above the resting deck, an additional wall including a vertical cylindrical portion which defines an outer surface and an inner surface and extends below said resting deck with its inner surface facing the inner surface of the first wall, said additional wall being attached on the outer surface thereof, with said resting deck said outer surface matching the outer surface of said first wall, and comprises at least one pair of clamping elements including each a portion respectively shaped to match the inner surface of said first wall and the inner surface of said additional wall for fastening the first wall of said support to the additional wall of an adjacent support.

BRIEF DESCRIPTION OF THE DRAWINGS

The invention details will be more clearly apparent from the following detailed description of a preferred embodiment of the modular step support, as illustrated by way of example in the accompanying drawings, where.

DESCRIPTION OF THE PREFERRED EMBODIMENT

Figure 1:
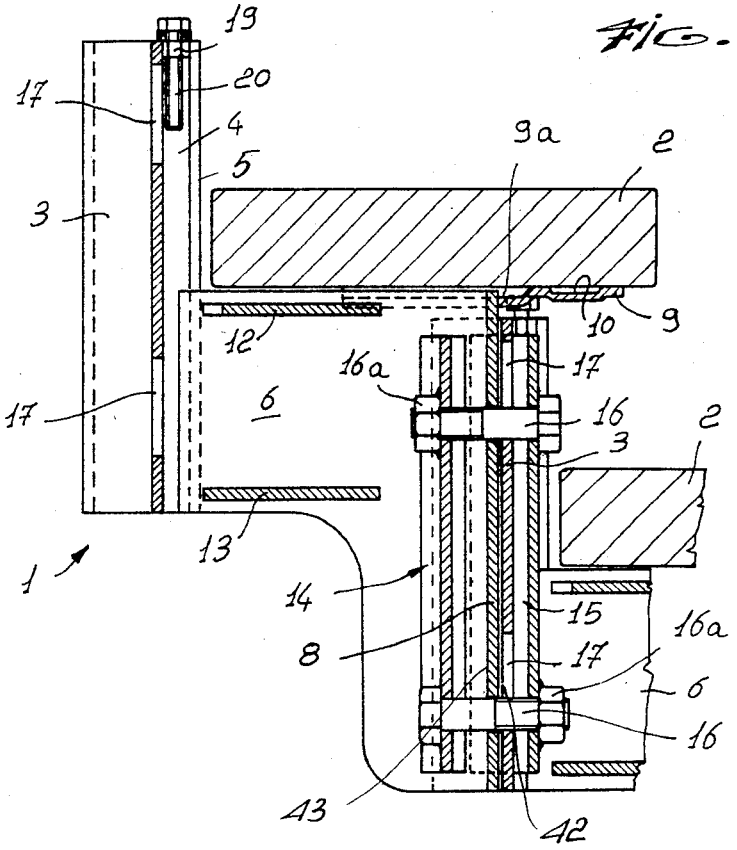
FIG. 1 shows a vertical section taken through a modular step support in the assembled position thereof.
Figure 2:
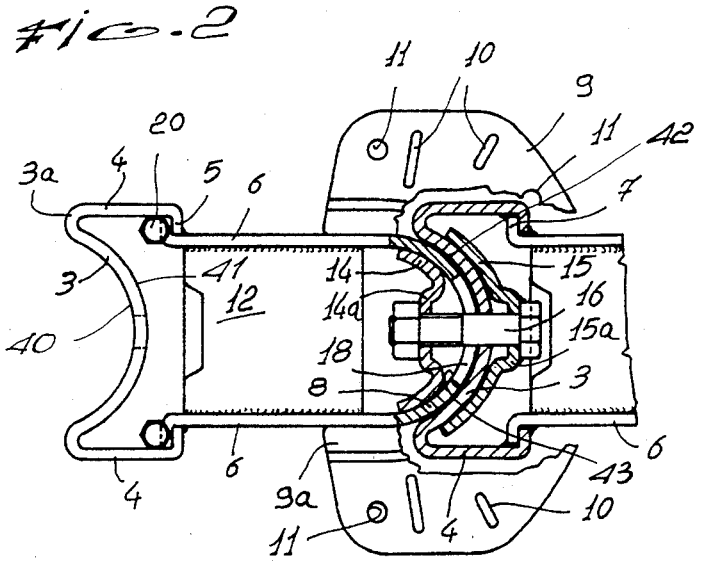
FIG. 2 is a partly cutaway and sectional plane view of said support.

The support 1 comprises a wall 3 including a vertical-axis cylindrical portion, which wall will be referred to as the rear wall hereinafter in relation to the stairway ascending direction. The longitudinal edges 3*a* of said cylindrical portion are upturned such as to connect to respective borders 4 which extend vertically parallel to one another on the convex side 41 of the cylindrical portion; the borders 4 have a rectangular shape and a height equal to that of the wall 3. The borders 4 have right-angle inwardly folded, longitudinal edges 5. Attached to the borders 4, such as by welding, are a pair of side walls 6 extending parallel to the borders; the side walls 6 have a respective vertical edge 7 which is folded outwardly to engage with the corresponding edge 5 of the borders 4. The side walls 6 have a height substantially equal to one-half the height of the rear wall 3 and extend from the lower edge thereof.

The side walls 6 are connected to each other, on the opposite side to that of attachment to the borders 4, by an additional wall 8, termed front wall, which comprises a vertical axis cylindrical portion. The front wall 8 extends downwardly to the side walls 6 and has an overall height which only marginally exceeds that of the rear wall 3.

Along the top edge of the front wall 8, there is attached, on the outer side 42, a horizontal footrest 9, which constitutes the resting deck for a respective step 2 of the stairway. The footrest 9 has an appreciably oval profile and has a plurality of stiffening ribs 10 formed thereon which are sunburst arranged. Moreover, along the concave section of the joint to the front wall 8, the edge of the footrest 9 defines a recess or depression 9*a* adapted to facilitate welding of the footrest to the wall. Finally, formed in the footrest 9, are suitably spaced apart holes 11 for the step fastening screws.

Plates 12,13 are secured horizontally between the two side walls 6 for strengthening purposes.

The front wall 8 has an outer surface 42 which matches the outer surface 40 of the rear wall 3; the front wall of each support can thus be coupled to the rear wall of a similar underlying support. For mutually clamping the coupled walls together, a pair of clamping elements 14, 15 are respectively located, one to rest onto the front wall 8, on the concave side 43, and the other to rest on the rear wall 3, on the convex side 41 thereof. The elements 14,15 comprise a cylindrical portion, each shaped to match the surface whereon it is to rest. The elements 14,15 define respective projecting portions 14*a*,15*a*, a longitudinal one and middle one, which perform stiffening functions and provide a flat surface.

Adapted to act on such flat surfaces are the heads of screw means 16, and respective nuts 16*a* are welded thereon, said screw means being threaded into said nuts to mutually clamp the elements 14,15. Suitable holes are provided in the elements themselves for inserting the screws 16; moreover, the screws 16, particularly two in number, are passed through the rear wall 3 of one support at respective slots 17 being elongated vertically and aligned with one another at a middle position of the wall 3, and are passed through the front wall 8 of an overlying support at respective slots 18, extending horizontally at different heights.

To the tops of the borders 4, inside the angle formed with the folded over edge 5, there is finally attached a nut 19 adapted to act as the nut for a respective screw 20 to adjust the step rise.

Figure 3:
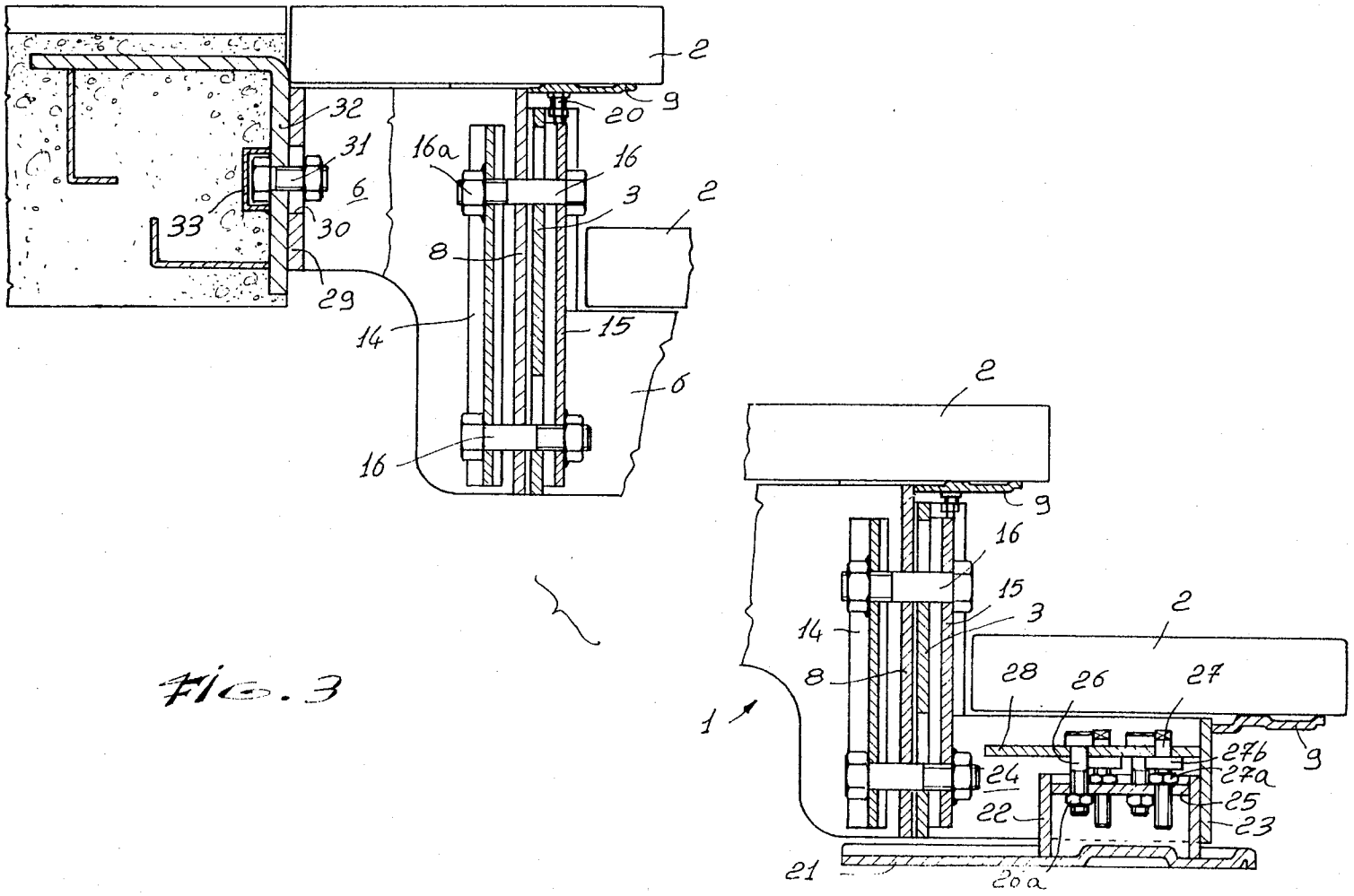
FIG. 3 shows a vertical section through a stairway formed from said modular supports, which view evidences in particular the upper and lower portions of the stairway.

The operation of the invention is apparent from the preceding description. The supports 1 are attached to one another modularly by means of respective clamps 14,15. Each support may be rotated relatively to adjacent ones, since the coupling takes place on the cylindrical surface of the walls 3 and 8; such rotation is allowed by the horizontal slots 18 in the front wall 8 through which slots the screws 16 for mutually fastening the supports are passed. It thus becomes possible to make stairways whose axes follow any path, if required even with an irregular geometry. It is also possible to adjust the step rise by operating the screws 20 which particularly facilitate the stairway assembling. In fact, one support 1 is positioned onto the underlying support, already installed in position, after operating the two screws 20 of the latter until they protrude above the tops of the respective borders 4 by a preset amount. The positioning is then achieved by resting the footrest 9 of the support on the heads of the screws 20 of the underlying support and by rotating, as mentioned, the upper support relatively to the lower one; the locking occurs then by tightening the screws 16 which, owing to the presence of the vertical slots 17, do not hinder the mutual axial movement allowed for the supports and consequent adjustment of the step rise. The stairway structure made up of the succession of modular supports 1 is made rigid at the ends with the floors of the respective landings. FIG. 3 particularly illustrates the supports for the lowermost and uppermost steps of the stairway. At the bottom, a base 21 is provided which is intended for securing on top of the landing floor. To the top of the base 21, there is attached a sleeve 22 with its axis vertical, which is intended for coupling to a front wall 23 of the support for the lower step; that front wall 23 comprises a cylindrical portion of limited height equal to that of side walls 24 which are similar to the walls 6 and made rigid with a rear wall 3 of the type described.

The sleeve 22 is closed at the top by a plate 25, which has, formed at an annular region thereof, internally threaded seats for a plurality of screws 26 and 27, which seats comprise a hole through the plate and a nut 26*a* or 27*a* welded thereto. Below the prismatic actuation head the screws 27 have a shoulder 27*b* for resting against the horizontal plate 28 which joins the walls 24 of the support together: thus, the rise of the first step can also be adjusted. The screws 26 lock the plate 28 onto the plate 25, and hence the first support to the base 21.

The support for the uppermost step in the stairway carries instead a rear wall 29 comprising a vertical plate secured across the end of the side walls 6. The wall 29 extends over a length exceeding the distance between the walls 6, and close to the ends, has vertical slots 30 for bolts 31 for fastening to a bracket 32 anchored on the landing floor; the head of the screws 51 is arranged within a box 33 of sort attached to said bracket.

Figure 5:
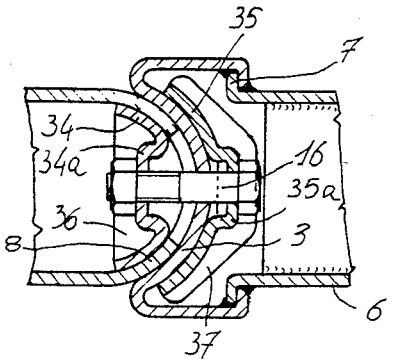
FIGS. 4 and 5 show respectively a vertical section view and plan view, partly cutaway, of a support provided with clamping elements according to a different embodiment.
Figure 4:
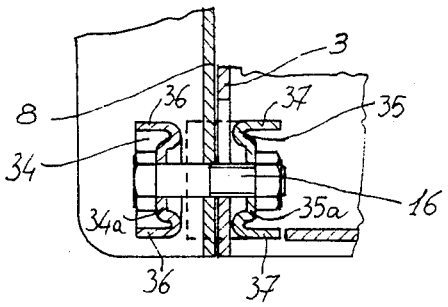

Finally, FIGS. 4 and 5 show a support having the coupled walls 3 and 8 clamped between two pairs of clamping elements, located respectively at the upper portion and lower portion of such walls. In the drawing, one of said clamping element pairs are shown and indicated at 34 and 35, respectively.

The clamping elements 34,35 comprise a cylindrical portion of limited height defining a respective projecting portion 34*a*,35*a*, extending longitudinally at the middle, which provides a centrally holed flat surface for the insertion of the clamping screws 16. The upper and lower cross edges of the clamping elements 34,35 are folded over to connect to respective flanges 36,37 which extend respectively on the concave side of the element 34 and on the convex side of the element 35, on respective plane transversely to the longitudinal axis of the clamping elements themselves, with stiffening functions.

The assembly of the clamping elements 34,35 is of course similar to the previously described assembly of the clamping elements indicated at 14,15.

It should be particularly enhanced that both the modular assembly of the supports, and the adjustment of the step rise, are extremely simple and rapid and can be easily accomplished as the stairway is being installed.

Moreover, the successive application of coverings is not required since the supports themselves form a continuous enclosure, the joining members being left on the inside.

In practicing the invention, the materials, shapes and dimensions may be any ones according to requirements.

I claim:

1. A modular support for stairway steps, adapted to be clamped with adjacent supports, characterized in that it comprises, as a unitary construction, a horizontal resting deck for a respective step, a first wall including a vertical cylindrical portion which defines an outer surface and an inner surface and extends above the resting deck, an additional wall including a vertical cylindrical portion which defines an outer surface and an inner surface and extends below said resting deck with its inner surface facing the inner surface of the first wall, said additional wall being attached on the outer surface thereof with said resting deck, said outer surface matching the outer surface of said first wall, and comprises at least one pair of clamping elements including each a portion respectively shaped to match the inner surface of said first wall and the inner surface of said additional wall for fastening the first wall of said support to the additional wall of an adjacent support.

2. A support according to claim 1, characterized in that it comprises, substantially at the top of said first wall, adjustable screw means adapted to bear the resting deck of an upper adjacent support.

3. A support according to claim 1, characterized in that said first wall and said additional wall are respectively provided with vertical and horizontal slots adapted for the insertion of screw means of fastening each said walls to the corresponding walls of adjacent supports.

4. A support according to claim 1, characterized in that said first wall is made rigid, at a lower portion thereof, with a pair of vertically parallel side walls, which side walls are connected to each other by said additional wall.

5. A support according to claim 4, characterized in that said additional wall extends below said side walls.

6. A support according to claim 1, characterized in that said first wall has longitudinal edges which are folded over and connected to respective vertically parallel borders, with said borders there being rigidly associated said side walls.

7. A support according to claim 6, characterized in that at the top of said borders there are secured respective nut members for said adjustable screws bearing the resting deck of the adjacent upper support.

8. A support according to claim 1, characterized in that said resting deck comprises a footrest having a joint in the form of a concave section arranged at and externally to the upper edge of said additional wall.

* * * * *